United States Patent [19]

English et al.

[11] Patent Number: 4,847,530

[45] Date of Patent: Jul. 11, 1989

[54] ARC DISCHARGE LAMP WITH ELONGATED OUTER ENVELOPE ORTHOGONAL TO LAMP BASE

[75] Inventors: George J. English, Reading; Harold L. Rothwell, Jr., Georgetown, both of Mass.

[73] Assignees: GTE Products Corporation, Danvers, Mass.; GTE Products Corporation, Danvers, Mass.

[21] Appl. No.: 112,646

[22] Filed: Oct. 26, 1987

[51] Int. Cl.[4] ..... H01J 61/32; H01J 61/34

[52] U.S. Cl. ..... 313/25; 313/634; 313/318

[58] Field of Search ..... 313/25, 318, 634; 362/216, 217, 223, 224, 363

[56] References Cited

U.S. PATENT DOCUMENTS 2,152,989 4/1939 Ewest et al. ..... 313/25

2,164,183 6/1939 Van Liempt et al. ..... 313/25

*Primary Examiner*—Kenneth Wieder

*Attorney, Agent, or Firm*—Joseph S. Romanow

[57] ABSTRACT

An arc discharge lamp having an elongated outer envelope being orthogonal or transverse to the central axis of the lamp base. The invention provides an optically precise, extremely rugged, very efficient, and long-lived light source particularly well suited for use in rotating navigational signals which are for use in rotating navigational signals which are frequently situated in remote locations and exposed to all types of weather conditions. In a preferred embodiment of the invention, the lamp comprises a base having a vertical central axis, a light-transmissive outer envelope elongated along a horizontal central axis, and an upwardly arched arc tube for horizontal operation mounted within the outer envelope. In comparison with filamented counterparts of equal wattage from the prior art, the arc discharge source provides greater luminous efficacy and lamp life. When a lamp in accordance with the invention is selected to match the observable range and flash period of an existing beacon, the operating power of the arc source is substantially reduced in comparison with the presently employed filamented source. A lamp in accordance with the invention may be retrofitted into existing navigational beacons; it may be powered from solar sources; and its use results in substantially reduced maintenance costs.

15 Claims, 2 Drawing Sheets

ARC DISCHARGE LAMP WITH ELONGATED OUTER ENVELOPE ORTHOGONAL TO LAMP BASE

The Government has rights in this invention pursuant to Contract No. GTCG23-85-C-20079 awarded by the United States Coast Guard.

CROSS REFERENCES TO RELATED APPLICATIONS

U.S. Pat. Application, Ser. No. 909,359, filed Sept. 18, 1986, and U.S. Design Pat. Application, Ser. No. 942,641, filed Dec. 16, 1986, both applications being assigned to the assignee hereof, contain related subject matter. U.S. Ser. No. 112,645, filed concurrently herewith and assigned to the assignee hereof, contains related subject matter.

TECHNICAL FIELD

This invention relates to an arc discharge lamp having an elongated outer envelope which is orthogonal or transverse to the lamp base.

BACKGROUND ART

The subject matter of this disclosure is a novel arc discharge lamp which may be used in a variety of lighting applications. The invention has been prompted, however, by a quest for an improved arc discharge light source which may be employed in a rotating beacon of a navigational signal.

The principal object of a navigational signal light is to emit as much light flux as possible from a reliable light source and direct the light into the plane of the horizon. The light may be radiated in all horizontal directions simultaneously, or it may be collected into one or more narrow beams which are mechanically rotated. There are basically two types of devices producing rotating beams or beacons. In the first type, a rotating screen surrounds a stationary lamp. The screen contains multiple lenses or other means for concentrating light. The rotating screen generally produces multiple beams, one beam associated with each lens or sector subtended by a lens. The emitted light within any sector is formed into a pencil beam and swept only within that sector. For an example of this type of beacon and a metal-halide arc discharge lamp having uniform azimuthal intensity for use therewith, see U.S. Pat. Application, Ser. No. 909,359, referred to above.

In the second type of rotating beacon device, a reflector or other means of concentrating the light is employed with the lamp. The entire optical system, i.e., lens and reflector, is rotated. This method generally produces a single beam; all of the emitted light is swept through 360 degrees repeatedly. It is this type of rotating beacon and, more particularly, the light source associated therewith, which is the subject of this disclosure.

Although filament lamps have been heavily relied on in the past for navigational signal lighting, modern light sources, more particularly arc discharge sources, will undoubtedly be employed in increasing numbers in the future because of the many advantages offered by these light sources. An arc discharge lamp generally provides better efficacy and longer life than its incandescent counterpart. The electrodes are heavier than the filament, so that the lamp may be more rugged. In an arc discharge lamp, the length and width of the arc are design variables to a large extent. In an incandescent lamp, the length and width of the filament are for the most part determined by the lamp wattage. Thus, there is greater flexibility in the choice of optical characteristics of the light source with arc discharge lamps than with comparable incandescent lamps. This is a significant factor in signal lighting, particularly with lamps of three hundred watts or less.

Xenon compact source and linear xenon lamps have been employed as light sources in lighthouses. See *Lamps and Lighting,* Third Edition, edited by Cayless and Marsden, on Page 259, published by The Pitman Press, Bath, Great Britain. In the Illuminating Engineering Society of North America's Lighting Handbook. 1981, Reference Volume, in FIG. 8-59(*b*) on Page 8-51, there is shown a twenty kilowatt xenon compact arc source with liquid cooled electrodes. This light source typically is employed in military searchlights where the principal operating position of the lamp is horizontal. More generally, see United States Coast Guard, Ocean Engineering Report No. 37 (CG-250-37) Visual Sionallinc: Theory and Application to Aids to Navigation, 1970.

In U.S. Pat. No. 4,498,027, issued Feb. 5, 1985, to Karlotski et al., there is disclosed a double-enveloped arc discharge lamp for horizontal operation having a line-of-sight arched arc tube to accommodate the upward bowing of the arc discharge during steady state operation of the lamp. The lower wall of the arch has lesser curvature than the upper wall to accommodate the position of the arc discharge during lamp start and warm-up when the arc tube is cooler and the arc is arched to a lesser degree. The arc tube is mounted within the outer envelope with the central axis of the arc tube substantially parallel to the central axis of the outer envelope. See also, U.S. Pat. No. 3,858,078, issued Dec. 31, 1974, to Koury; *A New Generation of Metal-Halide Lamps,* by Koury, Gungle, and Waymouth, Journal of the Illuminating Engineering Society, January 1975; and U.S. Pat. No. 4,056,751, issued Nov. 1, 1977, to Gungle et al.

In U.S. Pat. No. 2,218,013, issued Oct. 15, 1940, to Tice et al., there is shown an aviation beacon light having an elongated body which appears to be orthogonal to the stand or base (although the body rotates with respect to the stand).

It would be an advancement of the art if an arc discharge lamp could be provided which may be used for a variety of lighting applications and is well suited for navigational signal applications.

DISCLOSURE OF THE INVENTION

It is, therefore, an object of the invention to obviate the deficiencies of the prior art.

It is another object of the invention to provide a rugged and efficient arc discharge lamp having an elongated outer envelope which is orthogonal or transverse to the lamp base; and which may be constructed economically and used in a variety of lighting applications.

Another object of the invention is to provide an arc discharge lamp which is well suited for navigational signal lighting applications and, more particularly, to provide such a light source for use in a rotating beacon in combination with a suitable reflector.

Yet a further object of the invention is to provide a single-ended arc discharge lamp designed for base-down operation in which the major portion of its arc discharge during operation is positioned in or near a horizontal plane.

Still another object of the invention is to provide an arc discharge lamp which can be retrofitted into existing maritime rotating beacons and which provides improved performance when employed with such existing beacons.

A further object of the invention is to provide an extremely rugged arc discharge lamp being capable of withstanding a high level of vibration; and such lamp possesses reliable starting and operational capabilities under all weather conditions in a variety of isolated and possibly exposed salt-water environments.

An additional object of the invention is to provide an arc discharge light source for an existing maritime rotating beacon which has equivalent or better luminous intensity than its prior art filamented counterparts without generating too much heat for the existing enclosure, and which has longer life and substantially improved luminous efficacy in comparison with its prior art filamented counterparts.

These objects are accomplished, in one aspect of the invention, by provision of an arc discharge lamp comprising a base having a first axis. The base has means for receiving electrical power from an external source.

The lamp further comprises a light-transmissive outer envelope enclosing an interior. The outer envelope is mounted on the base. The outer envelope is elongated along a second axis (which may be straight or curved). The second axis intersects and crosses the first axis orthogonally.

An arc tube is mounted within the outer envelope. The arc tube is elongated along a third axis (which may be straight or curved). The third axis intersects and crosses the first axis orthogonally. The arc tube includes a body hermetically enclosing an interior and two opposed ends.

An electrode is mounted in each end of the arc tube. Each electrode protrudes into the interior of the arc tube. A fill is contained within the arc tube. The fill is capable of initiating and sustaining an electrical discharge arc between the electrodes during operation of the lamp. The discharge arc falls substantially along the third axis during steady stage operation of the lamp.

There are means within the outer envelope for mounting the arc tube within the outer envelope, and means within the outer envelope and lamp base for delivering electrical power to the arc tube.

A lamp constructed in accordance with the invention will provide a rugged, efficient, and long-lived general purpose light source. As will be explained below, this type of lamp is particularly well suited for marine navigational signal applications.

BEST MODE FOR CARRYING OUT THE INVENTION

For a better understanding of the present invention, together with other and further objects, features, advantages, and capabilities thereof, reference is made to the following disclosure and appended claims taken in conjunction with the above-described drawings.

A lamp in accordance with the invention provides an arc discharge lamp having an elongated outer envelope which is orthogonal or transverse to the central axis of the lamp base. This type of lamp may have a variety of applications. The best mode will be described herein as a rotating beacon lamp. In this mode, the lamp is employed with a suitable reflector for concentrating the emitted light into a narrow pencil beam in or near the plane of the horizon. The entire optical unit, i.e., lamp and reflector, is rotated continuously about a vertical axis. There is no intent, however, to limit the scope of the invention to a navigational signal, nor to any application requiring a reflector, nor to an application requiring a horizontal arc.

The term "luminous intensity" is a measure of luminous flux per unit solid angle in a given direction. It is frequently expressed in candelas. The term "azimuth" is used herein as a measure of direction in a horizontal plane. It is generally measured in angular units from a reference direction. The terms "beam spread" and "beam width" are used herein, synonymously, to indicate the angle between the two azimuthal directions within which the luminous intensity emitted from a light source is equal to or greater than fifty percent of its maximum intensity. The term "axis" or "central axis" as used herein need not be a straight line, nor does the term "cylinder" necessarily imply a straight cylinder. The term "flash period" as used herein with regard to a rotating beam sweeping across a fixed observer means the period of time the observer is within the beam spread for a single sweep of the beam.

Figure 1:
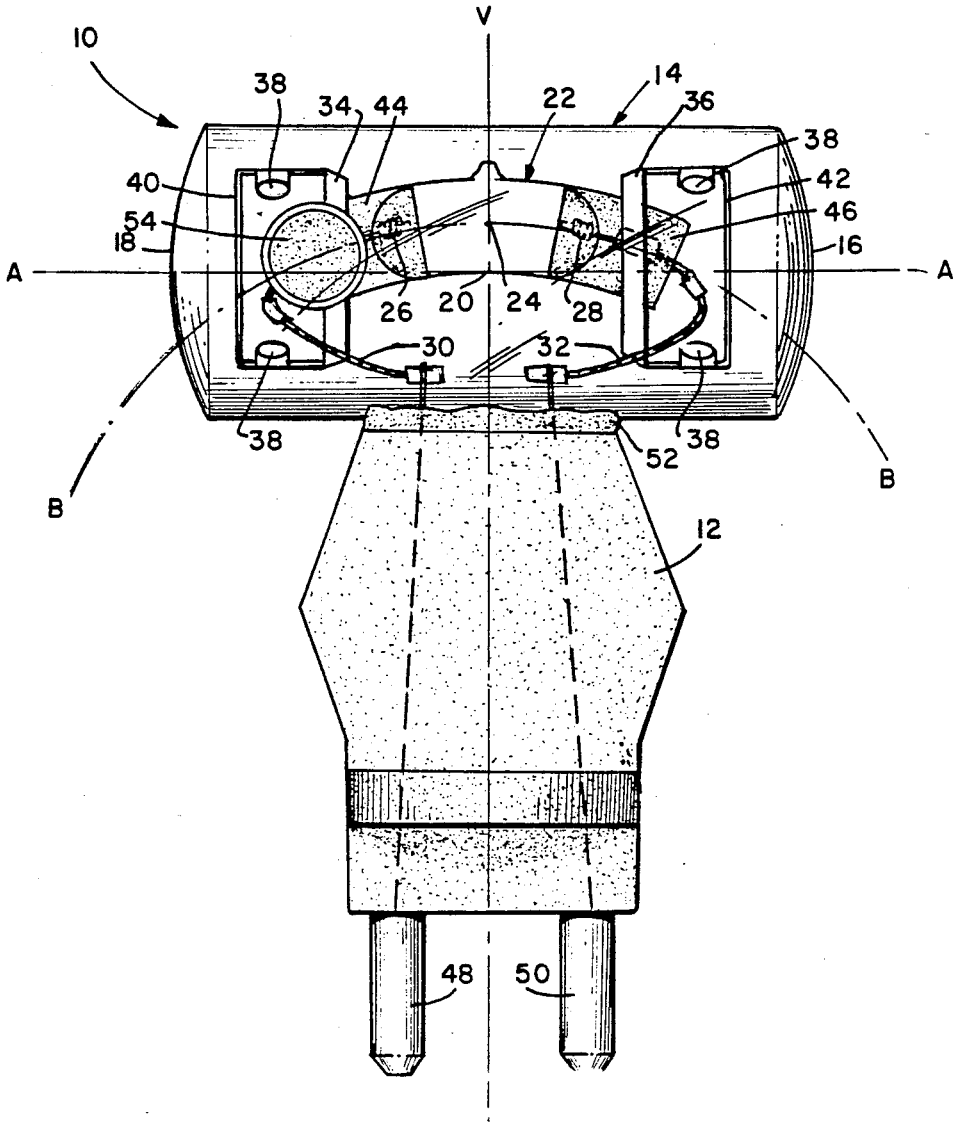
FIG. 1 is an elevational view of one embodiment of the invention having a cylindrical outer envelope mounted horizontally on a bi-post base with an horizontally mounted arched arc tube within the outer envelope.

FIG. 1 is an elevational view of a lamp in accordance with the invention. Lamp 10 comprises base 12, e.g., a mogul-type bi-post base as shown, having central axis V—V. In the embodiment of FIG. 1, lamp 10 is designed for base-down operation in combination with a suitable reflector in a beacon signal rotating about axis V—V. In alternate embodiments of the invention, there is no requirement that central axis V—V be vertical or that the lamp be operated base-down. In lamp 10, base 12 may have substantial weight and size, consistent with the overall ruggedness of a beacon lamp. Base 12 also facilitates in obtaining precise optical alignment and maintaining precise optical alignment between the arc discharge column and the beacon's reflector.

Light-transmissive outer envelope 14, which may be formed from hard glass (7720 Nonex, for example) with central axis A—A, is securely mounted on base 12. Envelope 14 is elongated along axis A—A. In the embodiment of FIG. 1, envelope 14 comprises the surface of a right circular cylinder about central axis A—A with domes 16 and 18 hermetically closing the ends of the cylinder. Axis A—A intersects and crosses axis V—V orthogonally at point 20.

Arched arc tube 22, having curved central axis B—B, is mounted within outer envelope 14. Arc tube 22 is elongated along axis B—B. In this embodiment, axis B—B is arched upward, i.e., in a direction away from base 12, and arc tube 22 has the general shape of a cylinder arched about axis B—B. Axis B—B intersects and crosses axis V—V orthogonally at point 24.

Arc tube 22 has a light-transmissive central body hermetically enclosing an interior and two opposed ends, 44 and 46, each end having a press seal formed therein. Electrodes 26 and 28 are mounted in press seals 44 and 46, respectively. Each electrode protrudes into the interior of the arc tube substantially along axis B—B. The lower wall of the arched arc tube has lesser curvature than the upper wall such that a straight line may be drawn between the tips of the electrodes without being impeded by the lower wall. This straight line approximates the position of the arc discharge at lamp start-up. There may be an auxiliary electrode (not shown in the drawing) to facilitate starting. Press seals 44 and 46 may have a heat-reflecting coating, such as zirconium oxide, about each press seal, as illustrated in the drawing, so that the operating temperature of the arc tube will be more nearly isothermal.

Arc tube 22 includes a fill within its interior, such fill including a metal-halide additive, such as mercury with a sodium/scandium iodide salt. The fill may also include an inert gas, e.g., argon, which facilitates lamp starting. The fill is capable of initiating and sustaining an electrical discharge arc between electrodes 26 and 28. Axis B—B and arc tube 22 are shaped such that the arc discharge will be positioned substantially along axis B—B during steady state operation of lamp 10.

The interior of outer envelope 14 preferably contains a fill gas, such as dry nitrogen at an appropriate pressure, say 300 torr. The fill pressure within the outer envelope affects the thermal characteristics of arc tube 22 which during operation is cooled in part by convective flow within the outer envelope. Accordingly, the pressure of the fill within the outer envelope must be matched with the desired thermal properties of arc tube 22.

In alternate embodiments of the invention, arc tube 22 may be a straight cylinder, particularly where the operating position of lamp 10 may not be position-oriented. In such cases, the corresponding central axis B—B will be a straight line perpendicular to the central axis of the base, and the arc discharge falls substantially along the central axis of the arc tube. A straight cylindrical arc tube would clearly be in order for a lamp having a vertically operating arc discharge. A lamp in accordance with the invention having a vertical arc is within the scope of the invention.

Figure 2:
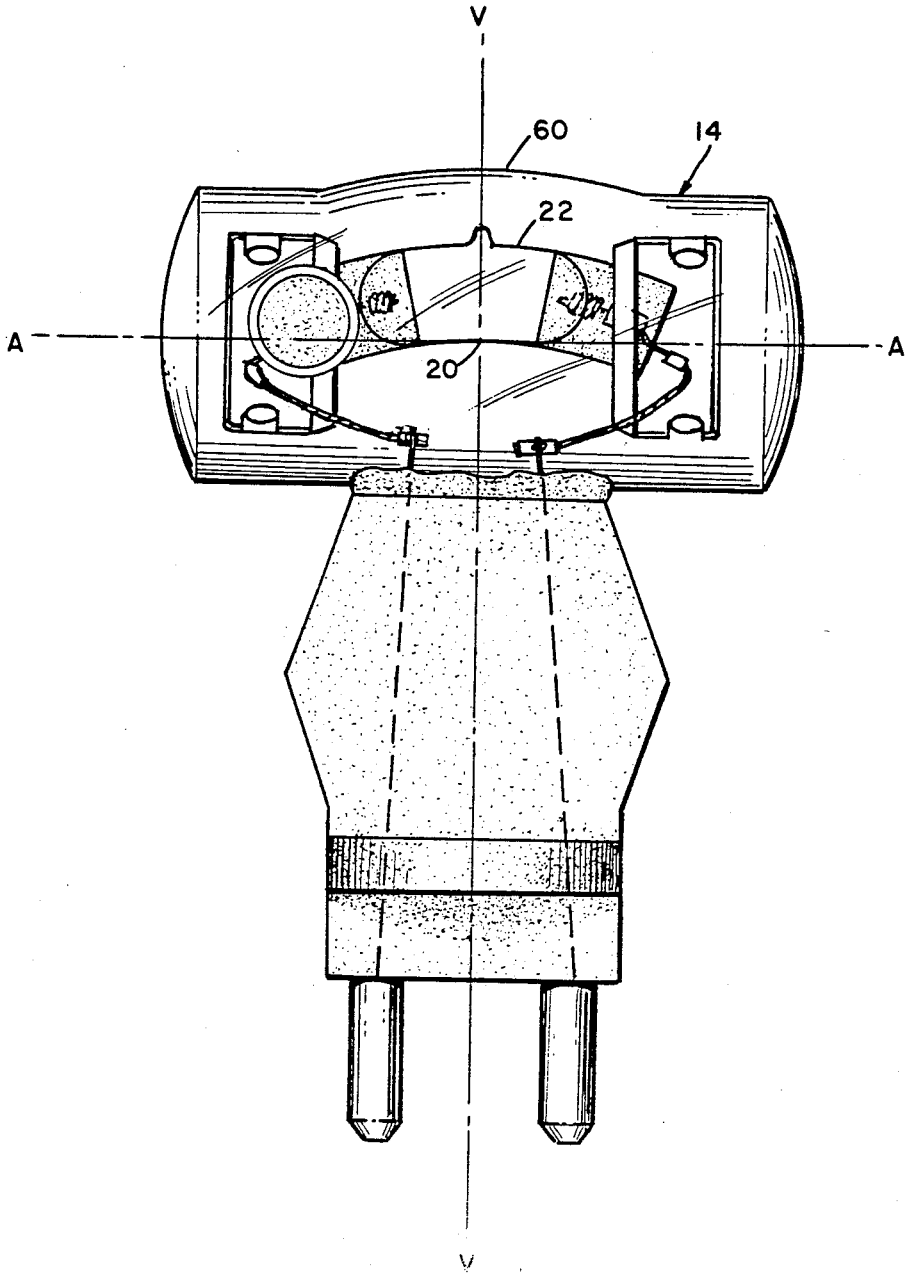
FIG. 2 is an elevational view of another embodiment of the invention being essentially the lamp of FIG. 1 wherein the upper wall of the outer envelope is arched upward substantially parallel to the upper wall of the arc tube.

FIG. 2 shows another embodiment of the invention having a substantially horizontal arc wherein upper wall 60 of outer envelope 14 is arched upward following the curvature of the upper wall of arc tube 20. This outer envelope shape has the advantage that the temperature distribution over the top of the outer envelope is more uniform and somewhat cooler during lamp operation because of the uniform distance between the upper wall of the outer envelope and upper wall of the arc tube. Note that central axis A—A of envelope 14, shown as a straight line in FIG. 2 (although it may also be arched following the contour of top 60), intersects and crosses axis V—V orthogonally at point 20. The straight cylindrical outer envelope, as shown in lamp 10 of FIG. 1, presently is preferred because of ease of construction and lower cost.

In lamp 10, there are means for mounting arc tube 22 within outer envelope 14, such as straps 34 and 36 tightly secured about press seals 44 and 46, respectively, of arc tube 22. Straps 34 and 36, which may be metal, may be mounted, such as by welding, to frames 40 and 42, respectively. Both frames may be mounted on outer envelope 14 by means of stiff expansion clamps 38, four clamps being employed in lamp 10 as shown. Each frame exerts an elastic and frictional force against the inside wall of outer envelope 14, such that arc tube 22 is capable of withstanding substantial vibration and jostling. A putty-type adhesive or other suitable energy-absorbing material, shown by indicator 52 of FIG. 1, may be employed between outer envelope 14 and base 12 in order to insulate outer envelope 14 from possible mechanical shock transmitted through the base. The adhesive may be a dielectric, or the lead-in wires may be electrically insulated. The thermal expansion coefficients of the glass outer envelope and adhesive should be sufficiently matched to avoid cracking the outer envelope at elevated temperatures.

Means are included within lamp 10 for supplying electrical power to arc tube 22 from an external source, such as electrically conducting bi-posts 48 and 50. Posts 48 and 50 of base 12 are coupled with electrical lead-in wires 30 and 32, respectively, which are in turn coupled with electrodes 26 and 28, respectively, of arc tube 22. Where frames 40 and 42 are electrically conducting, e.g., the frames are formed from relatively thick metal wire as shown in the drawing, preferably each frame is insulated from the electrical circuit of the lamp so that sodium migration from the interior of arc tube 22 will not be spurred by the presence of the frames at an electrical potential within the outer envelope. In such cases, lead-in wires 26 and 28 may be enclosed in a dielectric tube or covered with a dielectric coating to prevent the frames from making electrical contact with the lead-in wires.

Getter 54 may be included to absorb hydrogen and oxygen which, if permitted to be in contact with the wall of the arc tube, would diffuse into the arc tube and create chemical reactions which would degrade the light-transmissive property of the arc tube walls. Most getters of this type include barium oxide.

The observable range of a maritime beacon rotating with a given angular velocity is highly influenced by the luminous intensity and width of the emitted beam. The maximum range, assuming adequate intensity, is constrained by the height of the light source above the earth and the curvature of the earth's surface. A mariner typically prefers to see a "loom" of light over the horizon, requiring a portion of the beam to be emitted above the horizon plane and into the sky. A downward component is also useful for the benefit of small craft near the light source in foggy conditions. Notwithstanding these off-horizon considerations, the practical objective is to emit a broad, highly intense, beam in or near the plane of the horizon in order to maximize the observable range over varying weather conditions.

Lamp 10 is ideally suited for use in a maritime beacon. The horizontal arc has much wider extent than its filamented counterpart providing a wider beam spread. Because the arc is arched, the beam includes a vertical or off-horizon component which, when aligned, provides a loom of light partly above and partly below the horizon plane. For the same power, an arc discharge source has higher luminous efficacy than its filamented counterparts; conversely, for an equivalent observable range, the arc source requires substantially less power. Because of the lower power requirement, lamp 10 may readily be energized from a solar source thereby reducing the cost of maintaining a remote beacon. As previously mentioned, the arc source of lamp 10 is more rugged and has longer life than its filamented counterpart. These features also contribute to reduced maintenance costs for a remote beacon.

The particular design of lamp 10 permits the lamp to be retrofitted into an existing beacon. Since overheating is a constraint in an existing beacon and since an arc source has a higher visible light to infrared emission ratio than its filamented counterparts, the observable range of an existing beacon may be enlarged by providing an arc source with higher wattage than required for the beacon's observable range (while remaining within the overheating constraint for the beacon). Alternatively, an arc source may be overpowered during adverse weather conditions (while remaining within the overheating constraint for the beacon) without experiencing the catastrophic result typical of a filamented lamp. Since observable range is greatly reduced in inclement and foggy weather, operating the lamp at higher than rated wattage during these periods will ameliorate the reduction in observable range caused by the harsh weather.

WORKING EXAMPLE

A 175 watt arc discharge lamp, as shown in FIG. 1, was designed for the United States Coast Guard and retrofitted and tested in the rotating DCB-24 landfall searchlight. The observed lamp characteristics were as follows. The RMS voltage was 128 volts. The RMS amperage was 1.5 amperes. The luminous output after 100 hours of lamp operation was 16,000 lumens. The rated life for 12-hour operating periods was 7500 hours. The mean luminous output measured at 40% of the rated life was 12,000 lumens. The correlated color temperature was 4390 degrees Kelvin. The CIE Chromaticity Coordinates were: $x=0.3700$; $y=0.3904$. The color rendering index was 65. The outer envelope was formed from a T-16 hard glass blank. The arched horizontal arc column was 26 millimeters long, with 6 millimeter diameter, and having average luminance of approximately 9 candela per square millimeter. At present, the DCB-24 searchlight employs a 1000 watt, 120 volt, 3000 hour, 17,000 lumen, T-20 tungsten-halogen lamp with a 27 millimeter long, 6.4 millimeter diameter, vertically oriented, CC8 filament. The maximum observable ranges for the working example and its filamented counterpart were approximately the same, about 26 miles. The beam widths and respective flash periods of the two lamps for various rotational speeds were comparable (although the working example values were slightly better). Using these two lamps for comparison, the principal advantages of the working example of the invention are: an over 80% reduction in operating power; and a more rugged lamp having a greater than 100% increase in lamp life (and a commensurate reduction in maintenance costs).

While there have been shown and described what are at present considered to be the preferred embodiments of the invention, it will be apparent to those skilled in the art that various changes and modifications can be made herein without departing from the scope of the invention as defined by the appended claims.

We claim:

1. An arc discharge lamp comprising:

(a) a base having a first axis, said base having means for receiving electrical power from an external source;

(b) a light-transmissive outer envelope enclosing an interior, said outer envelope being mounted on said base, said outer envelope being elongated along a second axis, said second axis intersecting and crossing said first axis orthogonally;

(c) an arc tube mounted within said outer envelope, said arc tube being elongated along a third axis, said third axis intersecting and crossing said first axis orthogonally, said arc tube including a body hermetically enclosing an interior and two opposed ends;

(d) two electrodes, one of said electrodes being mounted in each end of said arc tube and protruding into said interior of said arc tube;

(e) a fill within said arc tube, said fill being capable of initiating and sustaining an electrical discharge arc between said electrodes during operation of said lamp, said discharge arc falling substantially along said third axis during steady state operation of said lamp; and (f) means within said outer envelope for mounting said arc tube, and means within said outer envelope and lamp base for delivering electrical power to said ar tube.

2. A lamp as described in claim 1 wherein said outer envelope is hermetically sealed.

3. A lamp as described in claim 1 wherein said outer envelope includes a body and two opposed ends, said body being shaped substantially in the form of the surface of a right circular cylinder.

4. A lamp as described in claim 1 wherein said first axis is a straight vertical line.

5. A lamp as described in claim 4 wherein said lamp is designed for base-down operation and when said lamp is operationally positioned said third axis and said arc tube are arched upward such that said electrical discharge arc is substantially centered within said arc tube during steady state operation of said lamp.

6. A lamp as described in claim 5 wherein said second axis is a straight horizontal line.

7. A lamp as described in claim 6 wherein said base is a mogul bi-post base.

8. A lamp as described in claim 5 wherein said electrical discharge arc is approximately twenty-five millimeters long with a six millimeter diameter and an average luminance of approximately nine candela per square millimeter.

9. A lamp as described in claim 1 wherein said fill within said arc tube includes a metal-halide additive.

10. A lamp as described in claim 1 wherein said lamp has a rated wattage of approximately one hundred and seventy-five watts.

11. A lamp as described in claim 5 wherein said lamp has a rated wattage of approximately one hundred and seventy-five watts.

12. A lamp as described in claim 11 wherein said lamp is employed as a light source in a rotating marine signal beacon, said beacon having an axis of rotation coincident with said first axis.

13. A lamp as described in claim 5 wherein said outer envelope has a top portion above said arched portion of said arc tube and said top of said outer envelope is arched upward.

14. A lamp as described in claim 2 wherein said outer envelope encloses a gaseous fill including nitrogen.

15. A lamp as described in claim 1 wherein said means for mounting said arc tube within said outer envelope includes an electrically conductive frame which is electrically isolated from the electrical circuit of said lamp.

* * * * *